US005452895A

United States Patent [19]

Ray

[11] Patent Number: 5,452,895

[45] Date of Patent: Sep. 26, 1995

[54] THREE DIMENSIONAL ROTATING PUZZLE THAT OPENS

[76] Inventor: Donald W. Ray, 8272 Clearsprings, Dallas, Tex. 75240

[21] Appl. No.: 296,446

[22] Filed: Aug. 26, 1994

[51] Int. Cl.[6] ..... A63F 9/08

[52] U.S. Cl. ..... 273/153 S

[58] Field of Search ..... 273/153 R, 155, 273/153 S

[56] References Cited

U.S. PATENT DOCUMENTS

| | | | |
|---|---|---|---|
| 4,452,454 | 6/1984 | Greene | 273/153 S |
| 4,484,744 | 11/1984 | Gmunder | 273/153 S |
| 4,522,401 | 6/1985 | Gustafson | 273/153 S |
| 4,558,866 | 12/1985 | Alford | 273/153 S |
| 4,889,340 | 12/1989 | Greene | 273/153 S |
| 5,074,562 | 12/1991 | Green | 273/153 S |
| 5,114,148 | 5/1992 | Liu | 273/153 S |

FOREIGN PATENT DOCUMENTS

| | | | |
|---|---|---|---|
| 2600903 | 1/1988 | France | 273/153 S |
| 1391673 | 4/1988 | U.S.S.R. | 273/153 S |
| 1388073 | 4/1988 | U.S.S.R. | 273/153 S |
| 2088728 | 6/1982 | United Kingdom | 273/153 S |

*Primary Examiner*—VIncent Millin
*Assistant Examiner*—Steven B. Wong

[57] ABSTRACT

A spherical puzzle that consists of eight five-sided pieces and thirty six-sided pieces which are connected by means of a locking rail system that allows all of the pieces to be shiftable around the three equatorial planes of the puzzle. This allows various color patterns to be placed on the surface of the sphere which can be scrambled and then rearranged in predetermined patterns. Also, the puzzle is hollow and can be opened if the pieces are arranged in the correct order.

5 Claims, 3 Drawing Sheets

FIG. 1
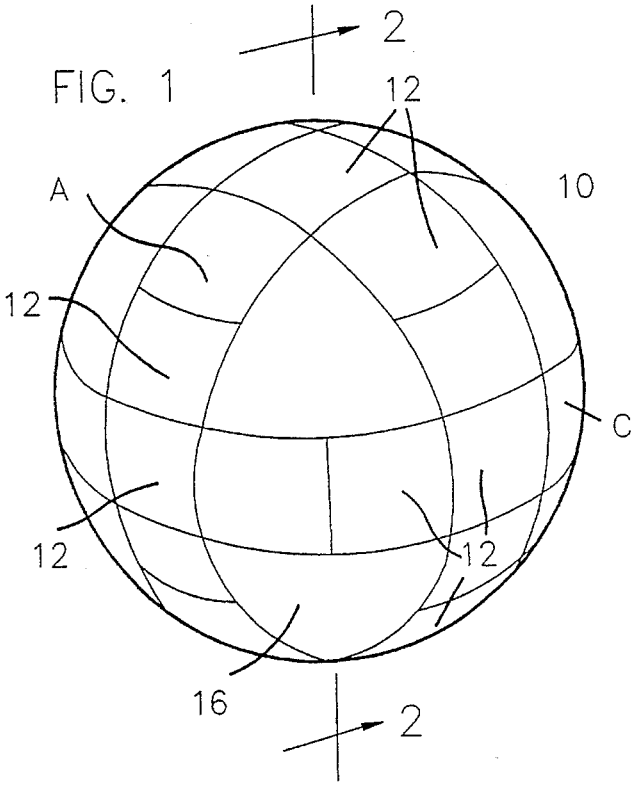
FIG. 3
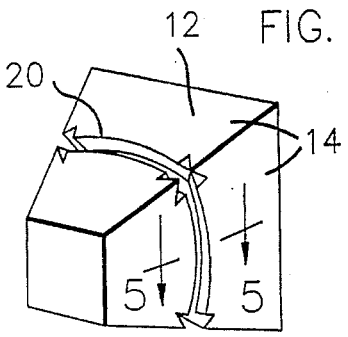
FIG. 4
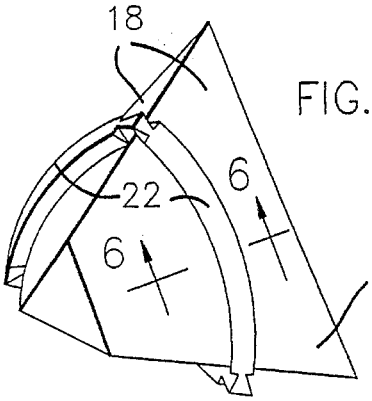
FIG. 5
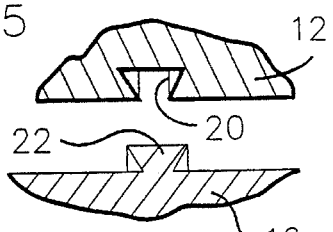
FIG. 6
FIG. 2
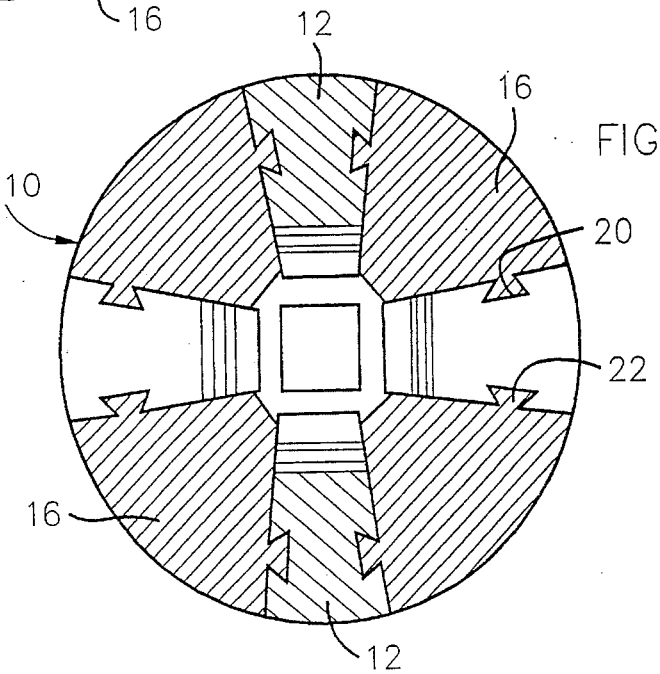

FIG. 7
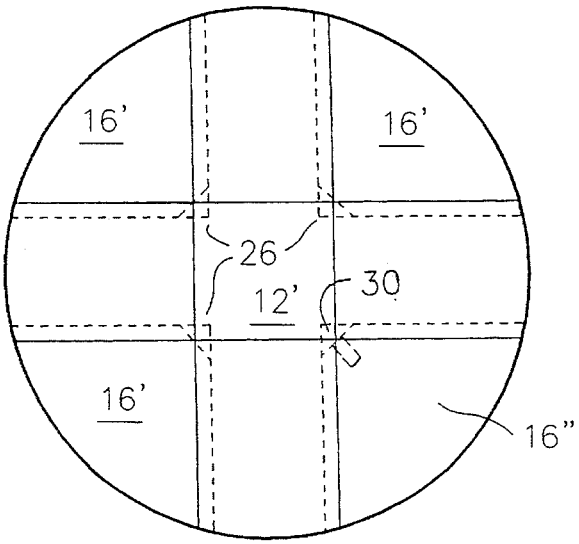
FIG. 8
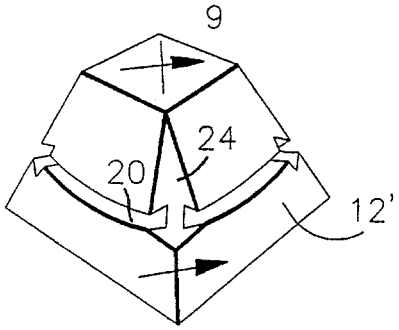
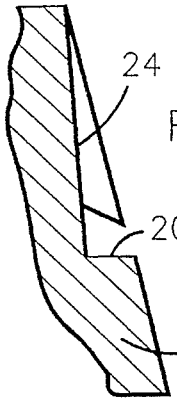
FIG. 9
FIG. 10
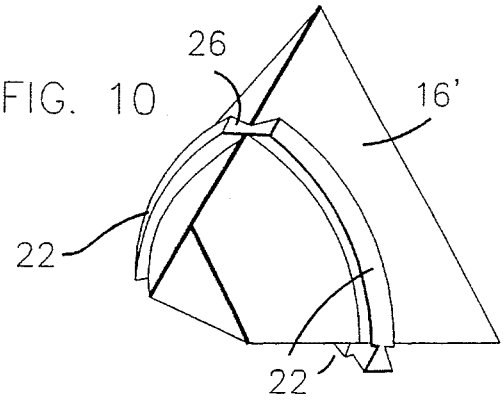
FIG. 11
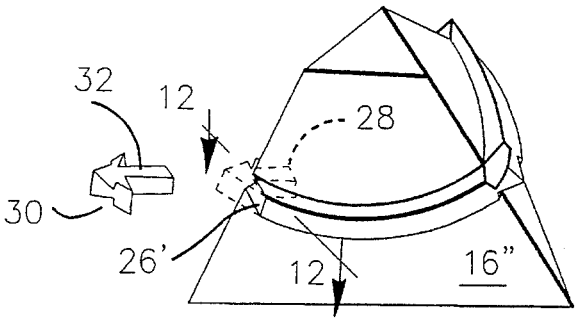
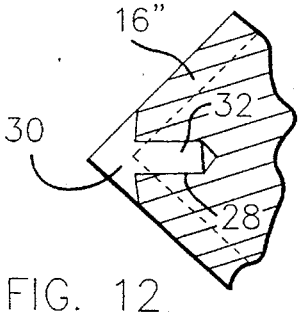
FIG. 12

FIG. 13
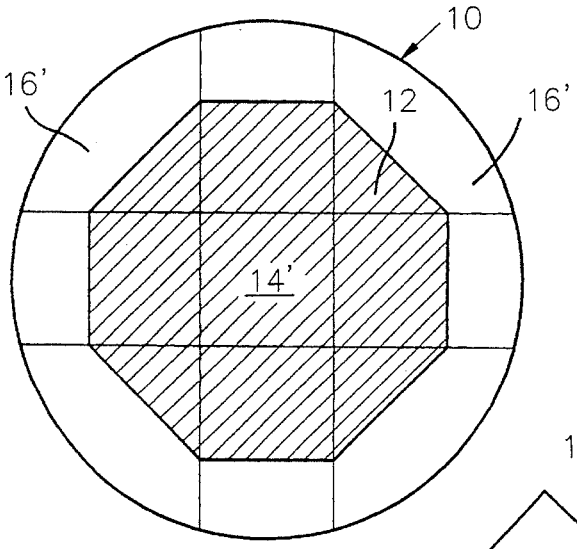
FIG. 14
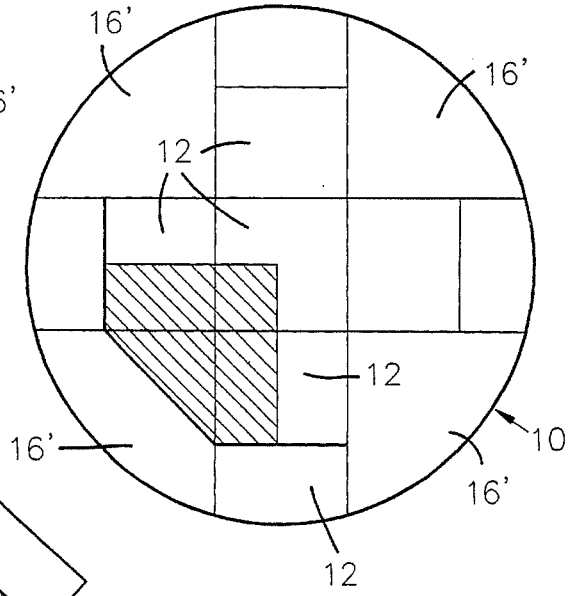
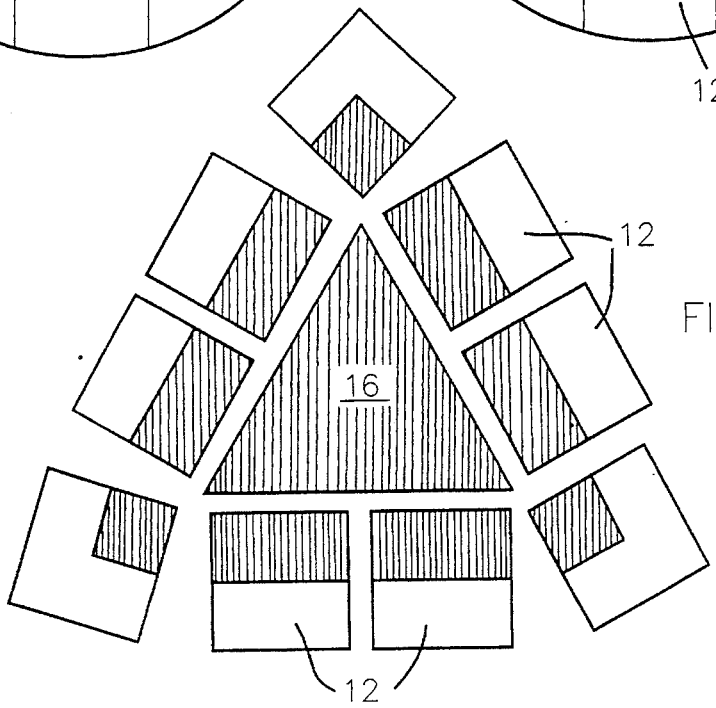
FIG. 15
FIG. 16
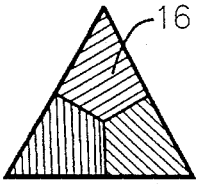
FIG. 17
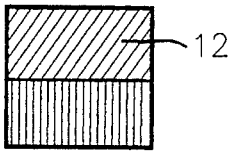
FIG. 18
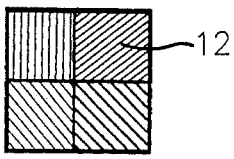

THREE DIMENSIONAL ROTATING PUZZLE THAT OPENS

BACKGROUND OF THE INVENTION

1. Field of the Invention

This invention relates in general to an amusement device and in particular to a spherical puzzle.

2. Prior Art

It is common for devices of this type to have eight five-sided sections of the device that are immobile. These sections form three circular tracks around the sphere, around which a second set of six-sided pieces are moved to form various patterns. This limits the possibilities of the puzzle and can cause the player to lose interest in a short time. It would be advantageous if the eight five-sided sections were movable and free to change relation to each other. If the unrestricted movement of all the pieces of the puzzle could be combined with the ability to open the puzzle when the pieces are placed in a specified order, player interest and the different possibilities of the game device would be substantially increased.

Some examples of the prior art spherical puzzles are set forth in the patents briefly described below.

The Gmünder U.S. Pat. No. 4,484,744 shows a spherical body that is comprised of eight equal five-sided sections which connect together to form a core that is solid and immobile.

The Gustafson U.S. Pat. No. 4,522,401 shows a solid core that has the eight five-sided sections bonded to it to assure that they remain in a fixed position and form the three circular grooves around the circumference of the puzzle.

The Greene U.S. Pat. No. 4,889,340 shows a spherical body that is assembled from eight (five-sided pieces), thirty (six-sided pieces), and one spherical core. The outer pieces of the puzzle are able to change relation to each other, but are designed to move around the solid core of the puzzle which eliminates the ability to open the puzzle.

In an alternate design of this puzzle, it is made to open, but the movement of the six-sided pieces are restricted. As shown in FIG. 11*a*, FIG. 11*b*, and FIG. 12, if part 124 is moved into an intersection between the three equatorial tracks of the sphere, its direction of travel can be changed ninety degrees so that it will then move on another equatorial track of the sphere. If part 122 is moved into an intersection between the three equatorial tracks of the puzzle, it will not change direction ninety degrees. The lower edge 138 of the four adjacent pieces block each other when this change of direction is attempted. It would be advantageous if the unrestricted movement of the primary design and the ability to open of the alternate design could be combined.

The Green U.S. Pat. No. 5,074,562 shows a spherical body that is molded as a single unit, or a pair of semi-circular half units that are secured together. The three equatorial tracks are molded in the surface of the puzzle base. This assures that the eight (five-sided) sections remain in a fixed position.

The Liu U.S. Pat. No. 5,114,148 shows a spherical body that is assembled from seven individual pans to form a rigid design that requires the eight (five-sided) areas to remain in a fixed position.

SUMMARY OF THE INVENTION

The object of this device is to provide a puzzle with improved capabilities to provide the player with increased entertainment and a greater ability to test their skill levels.

This device is assembled in a manner that allows all outer surfaces of the puzzle to be shiftable and change relation to each other.

This allows the choice of several different color patterns or other markings to be placed on the surface of the individual pieces so that the skill level required to solve the puzzle can vary from relatively easy to extremely difficult.

Another advantage of this device is that the type of assembly permits the puzzle to be hollow and allows it to be opened if the parts are aligned in a specified manner. This adds another dimension to the entertainment provided by this puzzle and facilitates the assembly of the puzzle for the manufacturers.

These, together with other points, will become more apparent upon reference to the following detailed description.

BRIEF DESCRIPTION OF THE DRAWINGS

FIG. 1 is a perspective view of a preferred embodiment of this invention.

FIG. 2 is a transverse section of FIG. 1 taken on line 2—2 shown in full scale.

FIG. 3 is an enlarged full view of a six-sided section shown in FIG. 1.

FIG. 4 is an enlarged full view of a five-sided section shown in FIG. 1.

FIG. 5 is an exploded view showing the groove used for the piece in FIG. 3.

FIG. 6 is an exploded view showing the rail used on FIG. 4.

FIG. 7 is a full faced view of FIG. 1 used to show how to disassemble the puzzle.

FIG. 8 is an enlarge full view of the six-sided figure shown in FIG. 7.

FIG. 9 is an exploded side view of a section of the piece in FIG. 8 showing the removed corner.

FIG. 10 is an enlarged full view of a five-sided piece with a corner of the rail removed.

FIG. 11 is an enlarged full view of a five-sided piece with a removable rail section.

FIG. 12 is an exploded view of a section of FIG. 11 showing the rail section removed.

FIG. 13 is a full scale view showing one color section for a possible six color combination.

FIG. 14 is a full scale view showing one color section for a possible twenty four color combination.

FIG. 15 is an expanded view of one section of a possible eight color combination.

FIG. 16 is a possible three color combination of part 16.

FIG. 17 is a possible two color combination of part 12.

FIG. 18 is a possible four color combination of part 12.

DESCRIPTION OF THE PREFERRED EMBODIMENT

Refer now to FIG. 1 which is an overall drawing of a preferred embodiment of the invention. The spherical rotating puzzle device 10 is comprised of two primary components consisting of thirty six-sided pyramid shaped pieces 12, each having four sides, a base, and a top where the peak of the pyramid has been removed, and eight five-sided pyramid shaped pieces 16, each having three sides, a base, and a top where the peak of the pyramid has been removed. The components are held together by a locking rail system, such as the dove-tail type illustrated in FIG. 5 for the female 20 and FIG. 6 for the male 22. FIG. 2 further shows how the components 12 and 16 are connected by the male 22 and female 20 parts of the rail system. This allows movement of the pieces around the three equatorial planes which are perpendicular to each other.

As illustrated in FIG. 4 the rail 22 as shown is circumferential a set distance from the center of the sphere 10. The three inner faces 18 of part 16 as well as the rail 22 are bowed out slightly to conform to and allow smooth movement of the groove 20 in part 12. Part 16 is an equiangular shaped pyramid with all angles approximately sixty degrees. The peak of the pyramid 16 is removed to form the hollow center of the sphere 10 as shown in FIG. 2. The base of part 16 is conical in shape to form the surface of sphere 10.

FIG. 3 shows the second major component of the puzzle a six-sided pyramid 12. Each has a circumferential groove 20 in its four sides that is the same distance from the center of the sphere 10 as that of the matching rails 22 on part 16. The opposing sides 14 of this part 12 are angled approximately 30 degrees from parallel so that twelve of them will form one of the three equatorial tracks B around the sphere 10. The peak of this pyramid 12 is removed to form the hollow core and the base is conical to form the surface of the sphere 10.

To operate this puzzle 10 and move the parts around the three equatorial planes, the parts as shown in FIG. 1 will be divided in three groups A, B, and C. Group A, which consists of four parts 16 and nine parts 12, will rotate parallel to group B. Group B, which consists of twelve parts 12, rotates parallel to and between groups A and C. Group C, which consist of four parts 16 and nine parts 12, rotates parallel to group B. The groups A, B, and C will be designated and operate in the same manner around the other two equatorial planes of the puzzle.

One of the ways to use this puzzle 10 would be to place various colors, symbols, or patterns on the outer surface of the individual pieces 12 and 16 of this device 10. The patterns would then be scrambled by rotating the pieces 12 and 16 around the three equatorial planes of the sphere 10. The player would then have to realign the pieces 12 and 16 to a predetermined pattern.

Some of the possible patterns are shown as follows. FIG. 13 would have six colors with pieces 12 being one color and pieces 16 being three colors such as shown in FIG. 16. FIG. 14 shows a pattern which would have twenty-four colors. Pieces 12 would have two colors as shown in FIG. 17 or four colors shown in FIG. 18. Parts 16 would have three colors as shown in FIG. 16. FIG. 15 shows another possible pattern which would have eight different colors. These patterns are given to show some of the possibilities of this puzzle 10 and are not intended to restrict other possible combinations.

Five pieces of this sphere 10 are modified slightly to facilitate opening the sphere 10 if they are aligned in a specific manner. These modified pieces 12 and 16 are as follows.

Three of the parts 16' have one corner of the rail 22 removed as shown in FIG. 10 and designated by the number 26.

One part 16" has a corner of the rail 22 that is removable as illustrated in FIG. 11. This removable rail 30 has a square shaft 32 as pan of it that slides into the corresponding tunnel 28 and hold it in place as shown in FIG. 12.

One six-sided piece 12' has one inner corner section 24 removed as shown in FIG. 8 and FIG. 9.

To open the puzzle 10, the modified parts 12' and 16' have to be aligned as shown in FIG. 7. FIG. 7 shows that the three parts 16' in FIG. 10 are aligned with space 26 facing the intersection. The six-sided part 12' shown in FIG. 8 is then positioned in the intersection with space 24 facing part 30. This allows the part 12' to be removed from the sphere 10. With the part 12' removed and the part 16" shown in FIG. 11 positioned as illustrated, the corner 30 can be removed. At this time all other parts 12 can be moved into the intersection and removed.

Another version of the puzzle 10 could be made by using four modified five-sided pieces 16' as shown in FIG. 10. These pieces 16' would be aligned as in FIG. 7 with the fourth piece 16' aligned with the space 26 in the position designated 30. In this configuration the removed rail sections are facing the same intersection and the need for the modified part 12' shown in FIG. 8 is eliminated and regular parts 12 can be removed as they are positioned in the intersection.

The foregoing description of the preferred embodiment of the invention has been presented for the purpose of illustration and description. It is not intended to be exhaustive or to limit the invention to the precise form disclosed. Many modifications and variations are possible in light of the above teaching. It is intended that the scope of the invention not be limited by this detailed description.

I claim:

1. A rotating puzzle device having pieces movable around three equatorial planes which are perpendicular to each other, the puzzle comprising:

a. Thirty (30) six-sided pyramid shaped pieces, each having a circumferential groove in the four sides a set distance from the center of the puzzle, with its opposing sides angled approximately thirty degrees from parallel and each having the peak of the pyramid removed and, b. Eight (8) five-sided pyramid shaped pieces each having a circumferential rail on its three sides a set distance from the center of the puzzle, each being equiangular with the angles set at approximately sixty degrees and having the peak of the pyramid removed, wherein said six-sided and five-sided pieces are connected to each by a locking rail system which allows them to be removable around all three equatorial planes and change relation to each other, and three of the five-sided pyramid shaped pieces have one corner of the rail system removed, one of the six-sided pyramid shaped pieces has one inner corner section removed, and one five-sided pyramid shaped pieces having one corner of the rail system that is removable.

2. A rotating puzzle device as set forth in claim 1, wherein various colors, symbols, or patterns would be place on the outer surface of the individual pieces allowing them to be scrambled and then rearranged in predetermined patterns by moving the pieces around the three equatorial planes.

3. The rotating puzzle device as set forth in claim 1, wherein the puzzle can be opened if the pieces given are aligned in a specified manner.

4. A rotating puzzle device as set forth in claim 1, wherein four of the five-sided pyramid shaped pieces have one corner of the rail system removed.

5. A rotating puzzle device as set forth in claim 4, wherein the puzzle will open if the pieces are aligned in a specified manner with the removed rail section of each facing the same intersection.

* * * * *